United States Patent [19]

Weston

[11] 4,410,778

[45] Oct. 18, 1983

[54] ARC SPINNER WITH MAGNETICALLY DRIVEN PUFFER

[75] Inventor: Donald E. Weston, Lansdale, Pa.

[73] Assignee: Brown Boveri Electric Inc., Spring House, Pa.

[21] Appl. No.: 186,609

[22] Filed: Sep. 12, 1980

[51] Int. Cl.[3] ..... H01H 33/88; H01H 33/18

[52] U.S. Cl. ..... 200/148 A; 200/147 R

[58] Field of Search ..... 200/148 A, 147 R

[56] References Cited

U.S. PATENT DOCUMENTS 4,052,577 10/1977 Votta ..... 200/148 A 4,249,052 2/1981 Votta et al. ..... 200/147 R

*Primary Examiner*—Robert S. Macon

*Attorney, Agent, or Firm*—Ostrolenk, Faber, Gerb & Soffen

[57] ABSTRACT

An arc spinner interrupter is provided with a chamber above the coil which contains a piston of ferromagnetic material. The chamber communicates, through a channel through the center of the coil, with an arc extinguishing region. The arc extinguishing region contains the movable contact and cooperating arc runner disk of the arc interrupter. During arc interruption, the magnetic field produced by the coil causes the arc between the movable contact and arc runner to circulate in the usual manner in a relatively static gas-filled arc extinguishing volume. The magnetic field of the coil also produces an attractive force on the ferromagnetic puffer piston and causes compression of the gas-filled volume above the coil and causes the movement of cool gas through the channel into the arcing region. The movement of cool gas into the arcing region increases the density of the gas in the arcing region and cools the gas in the arcing region, thereby decreasing the possibility of a restrike and increasing the interrupting capacity of the device.

14 Claims, 2 Drawing Figures

ARC SPINNER WITH MAGNETICALLY DRIVEN PUFFER

BACKGROUND OF THE INVENTION

This invention relates to arc spinner interrupters, and more specifically relates to a novel arc spinner interrupter which is provided with an auxiliary puffer mechanism for improving the interrupting capability of the device.

Arc spinner interrupters are well known and typically are disclosed in copending application Ser. No. 38,107, filed May 11, 1979 in the name of R. K Smith. The conventional arc spinner interrupter provides a magnetic field in a space between a stationary and a movable contact during the opening of the contact and interruption of the circuit. The magnetic field interacts with the magnetic field of the arc, and causes the arc to rotate continuously on a ring-shaped arcing contact runner. Continuous rotation of the arc distributes the thermal energy dissipated by the arc into the volume of gas between the contacts. At the time of current zero, when interruption occurs, the volume of gas has a relatively uniform temperature in the order of about 2000° K.

the dielectric recovery capability of the contact gap is controlled by this temperature and by the rate of thermal decay of the gas temperature. The ability of the device to withstand voltage following interruption is thus determined by gas density and temperature. Thus it is possible to increase the voltage rating of the device by reducing the gas temperature and increasing the gas density following the interruption operation.

The present invention provides a novel means for reducing the residual gas temperature of the volume of gas in the contact gap in a much shorter time than would occur relying on natural convection and thermal conduction characteristics, thereby to increase the rate of dielectric recovery of the gas.

BRIEF DESCRIPTION OF THE INVENTION

In accordance with the invention, the same coil which produces the field for driving the arc in its circulating motion is also used to drive a piston located above the coil in order to move a volume of relatively cool gas into the contact gap during and following interruption.

The movement of gas into the contact gap should be contrasted with the operation of a puffer type interrupter in which a gas blast is relied on to cool and deionize an arc to obtain its interruption. Arrangements of this type are known for arc spinner type interrupters as, for example, in U.S. Pat. No. 4,079,219 entitled "$SF_6$ Puffer for Arc Spinner" in the name of Donald E. Weston, dated Mar. 14, 1978. The puffer arrangement of the invention is one which simply replaces the gas volume in the contact interruption region in a non-blast manner, as contrasted to the high pressure, high volumetric movement of gas in a puffer type interrupter. Further, in the present invention, the gas density is increased in the contact interruption zone principally after the interruption operation has occurred and the movement of gas is not to obtain the interruption in the first instance.

A significant aspect of the present invention is that the same coil which is used to cause the arc spinning operation is also used to drive gas from the cool gas storage chamber adjacent the coil into the arc region.

The floating piston of the invention may have a steel ring attached thereto which is in close proximity to the coil and will be attracted to the coil by a force proportional to the current in the coil. This coil current is the arc current which flows during the interruption process. Thus, the magnetic attracting forces on the puffer piston will be determined by the arc duration and by the arc current magnitude and the puffer piston will be driven by a force proportional to the arc energy. The stroke of the puffer piston, corresponding to the volume of displaced gas, will then be proportional to the work that should be done in moving cool clean gas into the arc interruption region.

DETAILED DESCRIPTION OF THE DRAWINGS

Figure 1:
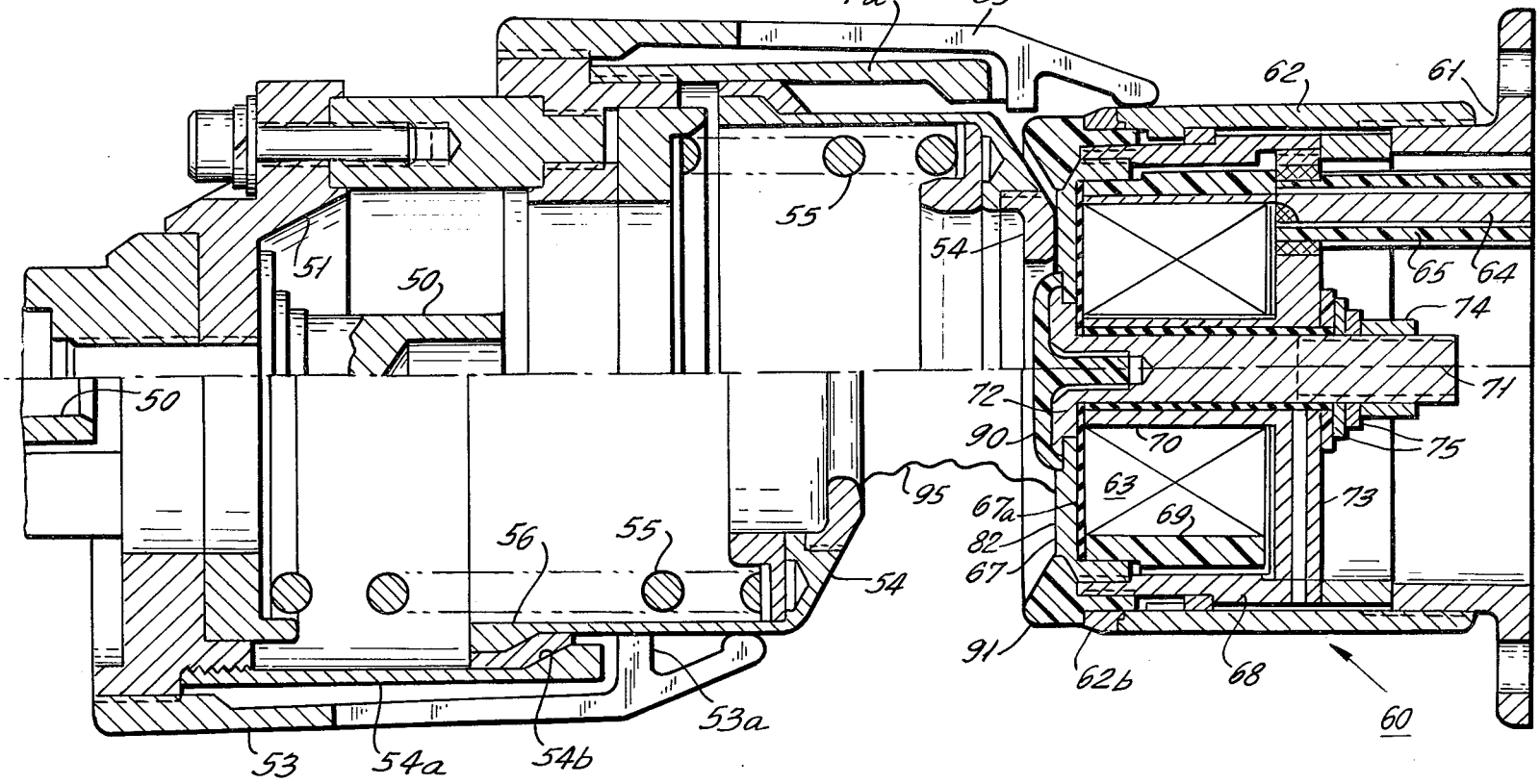
FIG. 1 PRIOR ART
FIG. 1 is a cross-sectional view of a prior art arc spinner interrupter having a movable contact assembly and a cooperating contact assembly of the type using a saturable magnetic core for the coil of the stationary assembly.

Referring first to FIG. 1, there is shown a typical arc spinner interrupter which can use the modification of this invention. The movable contact assembly includes a movable contact shaft 50 which has a conductive disk 51 extending therefrom and electrically connected thereto. Disk 51 carries a movable contact assembly which includes a plurality of flexible contact fingers 53 which form a tubular cluster of contact fingers. These fingers can be segments of a slotted cylinder and have interior projections **53*a* which slidably engage the conductive cylindrical extension of arcing contact 54. Hollow dished movable arcing contact 54 is slidably contained within sleeve 54*a* which is mounted inside the fingers 53. Contact 54 is pressed outwardly by the compression spring 55 toward an outermost position defined by the location at which the shoulder 56 engages a cooperating interior shoulder 54*b* of member 54*a***.

The stationary contact assembly 60 is carried from an aluminum support flange 61. An elongated copper chromium contact cylinder cr ring 62 is threadedly engaged to the aluminum flange 61 and the outer surface of the ring 62 slidably receives the ends of main movable contact fingers 53 of the movable contact assembly. Thus the contacts 53 and 62 serve the function of the main contacts 30 and 31, respectively, shown in FIG. 1. Ring 62 can be terminated by an arcing ring **62*b***.

The main coil consists of coil 63 which may be a spirally wound coil of thin, wide copper. By way of example, coil 63 may have 11 turns of copper sheet having a thickness of about 1/16 inch, with an inner diameter of 0.688 inch, an outer diameter of 1.438 inches and an axial length of about 2.0 inches. The coil convolutions may be insulated by a thin layer of insulation material such as a five mil thick aramid paper. One terminal of coil 63, shown as terminal 64, is surrounded by insulation tube 65 to ensure its insulation from the aluminum flange 61 and is electrically connected to the outermost convolution of coil 63.

A chromium copper ring 67 which defines the arc runner is seated directly on coil 63 and is insulated therefrom by a suitable insulation spacer **67*a*. The ring 67 is preferably coupled as close as possible to the coil 63. The innermost convolution of coil 63 is electrically connected to a cold rolled magnetic steel ring 70 which is, in turn, connected to outer conductive ring 68 and the arc runner 67 to complete the desired electric path from terminal 64 to the arc runner 67 which includes the coil 63 in series with the path. Note that the arrangement of FIG. 1** is an outside fed coil.

The exterior diameter of coil 63 is received within a ring 69 of insulation material such as G10 to structurally reinforce the outer diameter of the coil 63. Cold rolled steel ring 70 also confines the interior diameter of coil 63 to a particular shape.

A central magnetic steel bolt 71 extends through the interior diameter of the cold rolled steel ring 70. Bolt 71 has a flanged head 72 which overlaps the interior diameter of the arc runner 67 in order to define a concentrated flux just across the top of the arcing ring 67. Steel ring 70 has a flange 73 which extends across the end of coil 63. Flange 73 has a suitable notch through which the lead 64 may pass. A nut 74 threaded onto a threaded extension of the member 71 then securely fixes member 71 in place through the washers 75.

Ring 68, which is preferably of magnetic steel, may have an inwardly turned flange, if desired, to assist in focusing and concentrating the magnetic field across the exposed surface 82 of the arc runner 67.

A Teflon bolt 90 and a Teflon ring 91 may then be fastened relative to the arc runner 67 as shown to protect the underlying portions of the stationary current path structure from the deleterious effects of the arc which will extend from the surface 82 of the arc runner 67.

The total assembly shown in FIG. 1 may then be placed into an interrupter structure which may be of any desired type.

In operation, when the contacts are closed, the contact fingers 53 will be in the position shown to the left of the axis in FIG. 1 and the movable arcing contact 54 will press against and be in electrical contact with the bare surface 82 of the arc runner 67. In order to open the interrupter, the operating mechanism moves shaft 50 and the movable contact assembly down. The movable arcing contact 54 remains in engagement with the arc runner 67 until after the main contacts 53 and 62 have separated. After the separation of the main contacts, a current path is established from lead 64 through coil 63 to arc runner 67 and then into the movable arcing contact 54.

Once the movable contact assembly is moved sufficiently down in FIG. 1 and the main shoulder 56 is engaged by shoulder **54*b* of member 54*a*, the arcing contact 54 moves down and an arc 95 is drawn from the movable arcing contact to the arc runner 67. The arc 95 on the arc runnner 67 is exposed to the high magnetic flux density which is focused by the magnetic structure which encases the coil 63. This magnetic structure includes members 70, 73, 71 and the flux focusing flange 72. Thus, at low interrupting currents, a high flux density is provided to cause extremely rapid rotation of the arc 95** through the sulfur hexafluoride gas which fills the arc gap in order to extinguish the arc at the first current zero. As current increases, the magnetic material in the aforementioned path saturates so that, at higher instantaneous coil currents, the magnetic material in the magnetic path has no effect on the production of flux in the arcing area since the magnetic materials will saturate.

Figure 2:
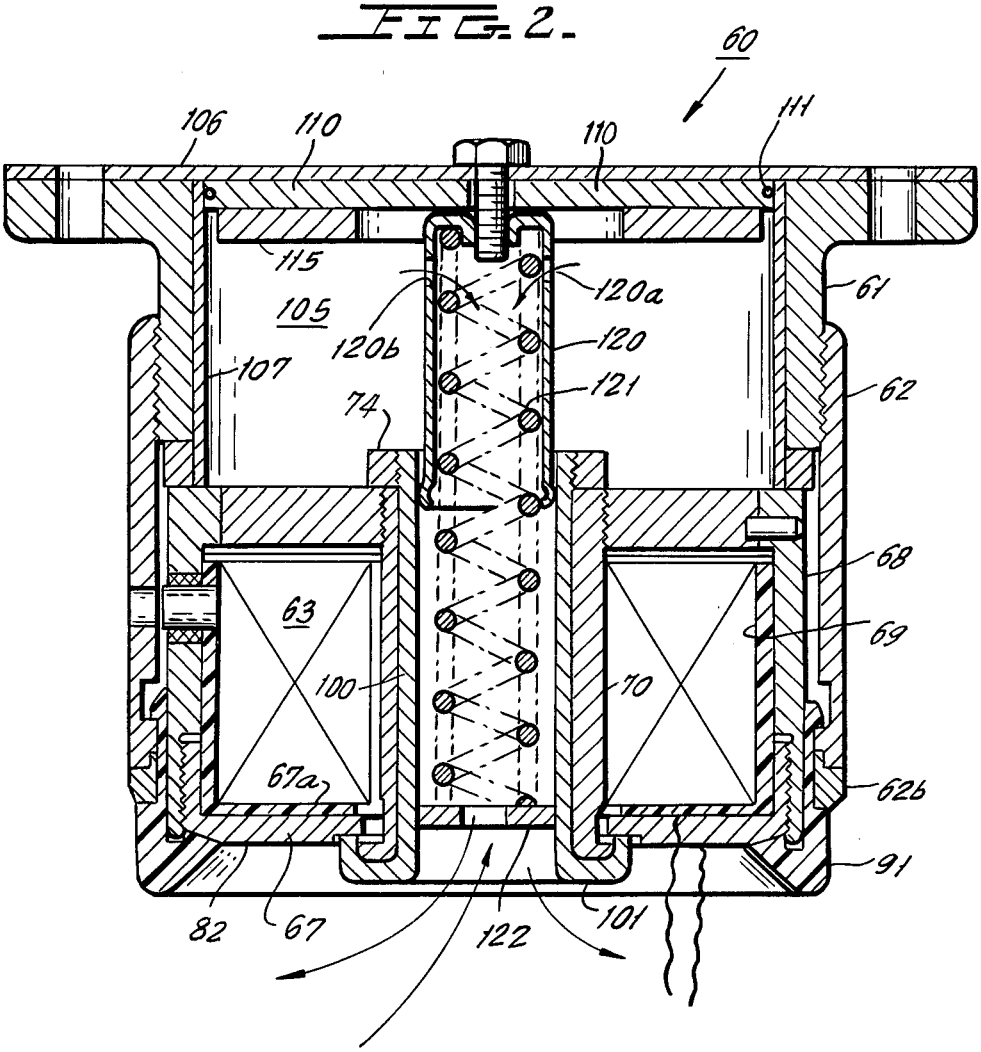
FIG. 2 is a cross-sectional view of a stationary contact assembly which is equipped with the novel puffer piston of the present invention.

FIG. 2 is a cross-sectional view of a stationary contact assembly 60 similar to that of FIG. 1 illustrates the manner in which the novel invention may be applied to the stationary contact assembly 60. In FIG. 2, all parts which are similar to those of FIG. 1 have been given the same identifying numerals. It will be noted that, in FIG. 2, the magnetic steel bolt 71 is replaced by a hollow cylindrical bolt 100 of magnetic steel. Bolt 100, which has one end fixed by the nut 74 and has the opposite end outwardly flanged at the flange 101, tends to concentrate magnetic flux across the gap 82 on the face of ring 67.

Disposed above the coil 63 is a cool gas volume 105 annular in shape and coaxial with the central axis of coil 63 and ring 67. The top surface of member 61 is covered by a suitable cover plate 106 which encloses a cylindrical walled member 107 which defines the volume 105. A puffer piston disk 110 of any desired material is then axially movably disposed in the volume 105 and is axially downwardly movable to compress the volume. A suitable sealing ring 111, which is a sliding ring, can be provided to ensure against the leakage of gas from around the disk 110 when it is operated in a compression mode. A magnetic steel ring 115 is then suitably fixed to the piston 100 to be movable therewith.

The distance between the magnetic steel ring 115 and the top of the magnetic steel coil housing of coil 63 is such that the magnetic field produced above the coil 63 will exercise a strong attractive force on the ring 115 to cause the ring 115 and the puffer piston 110 to move downwardly in response to current flow through the coil 63 and the consequent production of a magnetic field. Note that the magnetic material of the steel coil housing can be suitably shaped to ensure the production of a sufficiently strong magnetic field which links with the magnetic steel ring 115 to cause its desired motion.

A spring guide tube 120 is then fixed to the center of the puffer piston 110 and is movable therewith. Gas vents **120*a* and 120*b* may be formed in tube 120. Tube 120 receives one end of compression spring 121. The opposite end of spring 121 is seated on a stop plate 122 near the bottom of member 100. Consequently spring 121 will bias the puffer piston 110 to the upward position shown in FIG. 2 where the volume of cool gas volume 105 is maximum. Hollow member 100 defines a channel for conducting gas from the cold volume 105** to the arc zone or region of arc interruption of the arc during the arc interruption mode of operation of the interrupter.

In operation, interruption of the arc proceeds as previously described. However, the magnetic field produced by the arc current through coil 63 will also exert an attractive force on the magnetic steel ring 115, which force is proportional to the duration of the arc and the magnitude of the arc current. This attractive force will cause the puffer piston 110 to move downwardly to compress the cold gas volume 105 and thus move gas through openings **120*a* and 120*b* in the guide 120 and down through the channel in member 100 and into the arcing region. The movement of gas from the volume 115** is not at high speed and a high volume is not moved. Rather, the movement of gas is relatively slow and a relatively low volume of gas is moved in order to increase the gas density in the arcing region and reduce the gas temperature in the arcing region particularly immediately following arc interruption, thus increasing the ability of the interrupter to withstand recovery voltage.

The volume 105 can, of course, be any size desired and can be made equal to, less than or greater than the volume of gas between the contacts in their open position. The flow of cold gas should be timed to start preferably prior to current zero but made to continue through the period of interruption and dielectric recovery.

During the operation of the device incorporating the present invention, a turbulent gas bubble of relatively uniform temperature exists in the contact recovery zone of the arc spinner interrupter. This temperature is reduced and the density of the gas is increased more rapidly by introducing fresh cold gas in accordance with the invention. The magnetically driven puffer of the invention can supply fresh cold gas without increasing the work energy required for driving the contact system. Thus there is no mechanical connection to the breaker operating mechanism. As a further advantage of the invention, it will be noted that the puffer is self-regulating and derives its operating force from the current being interrupted and the arc's duration.

Although the present invention has been described in connection with a preferred embodiment thereof, many variations and modifications will now become apparent to those skilled in the art. It is preferred, therefore, that the present invention be limited not by the specific disclosure herein, but only by the appended claims.

What is claimed is:

1. An arc spinner interrupter comprising, in combination: a movable contact; an arc runner disk formed of a flat disk of conductive material engageable by said movable contact, and having one surface area for receiving the arc root of an arc drawn between said movable contact and said arc runner disk; a coil connected in series with said arc runner disk and fixed adjacent to the surface of said coil which is opposite to said one surface area; an arc extinguishing fluid disposed in the region between said movable contact and said arc runner disk; a gas-filled volume disposed adjacent said coil on the side of said coil away from said arc runner disk; a puffer piston movably supported in said gas-filled volume and containing a ferromagnetic member, whereby the magnetic field produced by current flow in said coil applies a force on said puffer piston to compress said gas-filled volume; and gas flow channel means connecting said region between said movable contact and said arc runner disk to said gas-filled volume whereby, when said interrupter is operated, relatively cool gas from said gas-filled volume flows, in a non-blast mode, into said region to increase the density of gas in said region and to reduce the temperature of gas in said region after an interruption operation.

2. The interrupter of claim 1 which further includes biasing means for biasing said puffer piston away from said coil.

3. The interrupter of claim 1 wherein said gas flow channel means includes a channel extending along the axis of said coil and the axis of said disk.

4. The interrupter of claim 1 wherein said gas-filled volume is an annular volume coaxial with said coil and said disk.

5. The interrupter of claim 2 wherein said biasing means comprises a spring disposed coaxially with the axis of said coil.

6. The interrupter of claim 3 which further includes biasing means for biasing said puffer piston away from said coil.

7. The interrupter of claim 6 wherein said gas-filled volume is an annular volume coaxial with coil and disk.

8. The interrupter of claim 1, 2, 3 or 4 which further includes a magnetic material having a magnetic permeability greater than that of air enclosing at least portions of said coil to define a relatively low reluctance magnetic path for magnetic flux around said coil and to the region between said one surface area of said arc runner disk and said movable contact.

9. An arc spinner current interrupter having puffer-assisted gas deionizing means for increasing the density of gas and cooling the gas in the interruption region to said interrupter after an interruption following an arc current zero wherein a single operating coil causes both arc spinning of the arc during interruption operation and operation of the buffer-assisted gas deionizing means comprising, in combinations: a movable contact movable along an axis; a stationary arc runner disk coaxial with said axis and engageable and disengageable with said movable contact, and operable in an arc interruption region to receive the rotating arc root of an arc drawn between said movable contact and said arc runner disk during current interruption operation; a coil coaxial with said axis and connected in series with said arc runner disk; said arc runner disk disposed adjacent a first side of said coil; an arc extinguishing fluid disposed in said arc interruption region; a gas-filled volume disposed adjacent a side of said coil opposite said first side; a puffer piston movably supported in said gas-filled volume and containing a ferromagnetic member, whereby the magnetic field produced by current flow in said coil applies a force on said puffer piston to compress said gas-filled volume; and gas flow channel means connecting said region between said movable contact and said are runner disk to said gas-filled volume.

10. The interrupter of claim 9 which further includes biasing means for biasing said puffer piston away from said coil.

11. The interrupter means of claim 9 wherein said gas flow channel means includes a channel extending along the axis of said coil and the axis of said disk.

12. The interrupter of claim 9 wheren said gas-filled volume is an annular volume coaxial with said coil and disk.

13. The interrupter of claim 10 wherein said biasing means comprises a spring disposed coaxially with the axis of said coil.

14. The interrupter of claim 9, 10, 11 or 12 which further includes a magnetic material having a magnetic permeability greater than that of air enclosing at least portions of said coil to define a relatively low reluctance magnetic path for magnetic flux around said coil and to the region between said one surface area of said arc runner disk and said movable contact.

* * * * *